United States Patent [19]

Bailey

[11] 4,036,195

[45] July 19, 1977

[54] UNIT FUEL INJECTOR

[75] Inventor: John M. Bailey, Dunlap, Ill.

[73] Assignee: Caterpillar Tractor Co., Peoria, Ill.

[21] Appl. No.: 634,952

[22] Filed: Nov. 24, 1975

[51] Int. Cl.[2] ..... F04B 35/02; F02M 61/00

[52] U.S. Cl. ..... 123/139 AK; 123/139 AC; 417/387

[58] Field of Search ..... 123/139 AK, 139 AC, 123/139 AE, 140 FP; 417/386, 387; 92/181 R, 182

[56] References Cited

U.S. PATENT DOCUMENTS

| | | | |
|---|---|---|---|
| 2,424,943 | 7/1947 | Nicolls | 417/387 |
| 2,734,531 | 2/1956 | Bizak | 92/181 R X |
| 3,029,737 | 4/1962 | Bessiere | 417/386 |
| 3,782,864 | 1/1974 | Perr | 123/139 AK X |
| 3,847,510 | 11/1974 | Fenne | 123/139 AC X |

*Primary Examiner*—Carlton R. Croyle
*Assistant Examiner*—Michael Koczo, Jr.
*Attorney, Agent, or Firm*—Phillips, Moore, Weissenberger, Lempio & Majestic

[57] ABSTRACT

A combination pump-injector device directly mountable upon the cylinder heads in an internal combustion engine. The device includes a housing with a spring biased cam operated constant stroke reciprocating piston therein and an unrestrained free-floating plunger means mounted between the piston and an injector valve which communicate directly with the engine cylinder. A quantity fuel metering device transfers a predetermined amount of fuel to a chamber communicating between the free-floating plunger and the injector valve and tends to move the free-floating plunger toward the reciprocating piston. A secondary fluid supply communicates with and fills a second chamber disposed between the piston and the free-floating plunger and counteracts the tendency for the free-floating plunger to move toward the piston. The secondary fluid chamber includes first and second fluid escape and entry ports which determine the beginning and termination of an injection cycle. Upon movement of the piston toward the plunger, injection begins when the reciprocating piston covers said first port and the plunger means is forced, under the influence of the fluid trapped within the secondary fluid chamber, toward the injector valve which valve will open when a certain predetermined injection pressure is reached. When the second secondary fluid chamber port is uncovered by the free-floating plunger, injection will abruptly terminate. The device also includes means for utilizing the secondary fluid as a lubricant between the moving parts and the housing.

5 Claims, 1 Drawing Figure

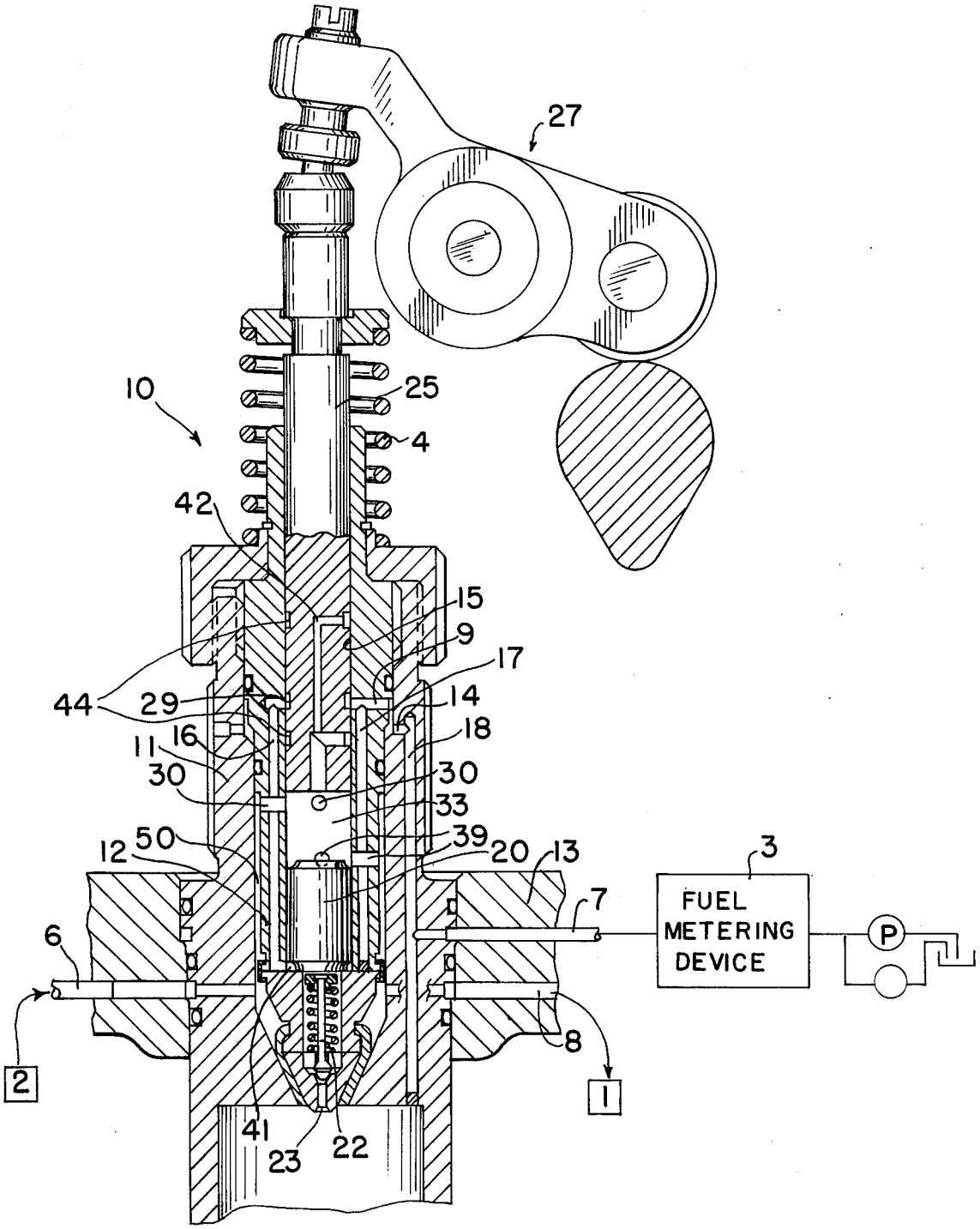
27
10
25
4
42
15
9
17
44
29
14
18
11
16
30
30
33
39
12
50
20
13
3
7
FUEL
METERING
DEVICE
P
6
8
2
1
41
23
22

UNIT FUEL INJECTOR

BACKGROUND OF THE INVENTION

In conventional fuel pumping systems for internal combustion engines such as a diesel engine, remotely disposed fuel pumps communicate with an injection valve located in the head of each engine cylinder by means of fuel lines. While such systems operate effectively in small capacity engines operating under normal load conditions, such systems are less effective when engine rpm and mean effective pressures are increased.

The relatively wide spacing between the pump and injector valve accommodates a relatively large volume of fuel which is subject to sizable variations in pressure and temperature and because the fuel has some compressibility and the speed of pressure impulses is limited to the speed of sound may cause difficulties such as the substantial time lag between the pumping action and the actual injection of the fuel into the cylinder. To remedy this latter problem, it is usually necessary to provide a sophisticated timing advance mechanism to achieve efficient fuel injection at varying engine speeds.

The unit injector, a device which broadly includes a high pressure fuel pump and injector mechanism in the same housing attached to the combustion chamber of the engine with which it is associated, has been developed to overcome the above-noted disadvantages of the conventional systems. By utilizing a low pressure fluid transfer mechanism for fuel metering and speed control, the instant unit injector can accurately, and with a minimum of expensively machined apparatus, achieve high pressure injection of fuel into the engine cylinder with improved control of injection and with precise timing.

Representative of some prior art attempts to deal with related difficulties are U.S. Pat. No. 2,898,051; 2,985,378; 3,075,707 to Teichert, Falberg, and Rademaker respectively. None of these patents, however, teaches the particular utilization of an unrestrained free-floating plunger disposed between a power piston and an injector valve as engrossed by the present invention.

SUMMARY AND OBJECTS OF THE INVENTION

This invention relates to a unit fuel injector having two pumping members; a constant stroke power piston and an unrestrained free-floating plunger means. Fuel is directed from a remote low pressure source to an injector valve communicating with an engine cylinder. The power piston has a stroke of constant length and said piston periodiclly covers and uncovers fluid communication means in timed relationship to crank shaft position. The free-floating plunger means is moved in one direction by the fuel metered from the low pressure source and is urged in another direction by a secondary fluid which acts as a hydraulic piston and as a sealing and lubricating medium. When the power piston begins a power stroke, secondary fluid trapped between the plunger and the piston forces the plunger toward the injector valve until sufficient pressure is developed to open the injector valve. At the end of a power stroke, the secondary fluid trapped between the piston and plunger is released by virtue of the plunger uncovering an escape port to rapidly terminate the injection cycle.

It is an object of this invention to provide a relatively inexpensively fabricated fuel injection device which comprises a pump and injector valve within the same housing.

It is another object of this invention to provide such an injection means utilizing an unrestrained free-floating plunger means acted upon by fluid within a chamber which has a stroke determined by the amount of metered fuel delivered thereto by a remotely disposed low pressure metering device.

Another object of the present invention is to provide such a fuel injection system wherein the injection cycle is sharply delineated both in initiation and termination without specially machined scrolls and by-pass passages on the pumping members.

A further object of the present invention is to provide such a fuel injection system whereby secondary fluid is used as a hydraulic piston to deliver fuel to an injector valve and is also used to seal and lubricate the moving parts of the unit fuel injector.

Other objects and advantages of the invention will become apparent from the following description and drawing.

BRIEF DESCRIPTION OF THE DRAWING

The sole figure is a sectioned elevation of the major components of the present invention with some parts illustrated schematically.

DETAILED DESCRIPTION

Referring to the drawing, the unit injector of the present invention, shown generally at 10, has a housing 11 which mounts sealingly within the cylinder head 13 of a diesel engine with which the unit is associated. The device includes power piston 25 biased upwardly from the housing by spring means 4 and intermittantly powered on a pumping stroke by a conventional can and linkage system 27. The timing of the cam is directly related to crank shaft rotation.

Disposed within the bore 15 with the power piston is a free-floating plunger means 20. The plunger is unrestrained by any mechanical means and is free to reciprocate within the portion 12 of housing 11.

An injector valve assembly 22 is disposed immediately beneath the floating plunger 20 and, depending upon the pressure to which it is exposed, will admit or prevent the flow of fuel to the engine cylinder through an orifice 23 as more fully explained hereinafter.

A fuel metering device 3 is provided for supplying predetermined fixed quantities of fuel to the unit injector through the passage 7. The details of the fuel metering device 3, per se, are not part of this invention and either of the systems taught in U.S. Pat. No. 2,984,230 and 2,984,231 to Cummins may be utilized. However, the function performed by the device 3, whatever its specific design, must be to supply a metered quantity of low pressure fuel to the passage 7 for periodic transfer to the underside of the plunger 20 for high pressure communication through the valve 22 to the engine combustion chamber.

Chamber 33 is formed within the bore 15 by the adjacent end surface of the piston 25 and the plunger 20. Communicating with the chamber 33 are the ports 30 and 39 which communicate, through an annular chamber 50 and passages 6 and 8 respectively, with a source of supply of a secondary fluid 2 and with a drain sump 1 therefore.

Such secondary fluid is preferably heavy lubricating oil or may be one of the same composition as the fuel admitted from the metering device 3. Communicating with the passage 7 is a drilled passageway 18 which communicates with cross passageways 14 and 9 which in turn communicate with drilled passageway 16 by way of groove 29 in piston 25 while piston 25 is in the up position as shown in the figure. Passageway 16 communicates with an underlying chamber 41 in direct communication with the injector valve 22 when the plunger 20 is lifted. The injector valve 22 is spring biased to open upon the achievement of a given predetermined pressure level within the chamber 41.

The secondary fluid in the chamber 33 communicates with annular grooves 44 by way of a central passageway 42 and suitable cross passages in the piston 25. The purpose of this provision is to provide a band of fluid under the same pressure as the fuel in the passage 16, 17 and chamber 41 to prevent the leakage of any high pressure fuel past the clearance between the piston 25 and the bore 15 into the engine valve compartment. The high pressure secondary fluid from the grooves 41 which does leak into the valve compartment is not detrimental thereto because it can mix with engine lubrication oil and also provides lubrication for reciprocation of the piston within the bore 15.

In operation, a measured quantity of fuel at low pressure from the device 3 enters, via the passage 7, 18, 14, 16, etc., the chamber 41 whereupon it acts on the lower surface of the plunger 20 and moves the plunger upwardly to reduce the volume of chamber 33. Concurrently, a supply of secondary fluid from the source 2 is passed, by way of the passageways 6, 50, 30, etc., into the chamber 33. With the piston 25 disposed as illustrated in the drawing, the low pressure fluid in the chamber 33 would drain to the sump 1 through the ports 30 or 39. However, upon movement of the plunger 20 upwardly, the port 39 is covered thereby. Upon initiation of the power stroke by the piston 25, a slight downward movement of such piston will block communication between passage 9 and passage 16 and also cover the port 30 preventing the secondary fluid from leaving the chamber 33 and creating a hydraulic piston between the piston 25 and plunger 20.

With both the ports 30 and 39 covered and communication between passage 16 and passage 9 block, further movement of the piston 25 toward the plunger 20 increases the pressure both in the chamber 33 and the chamber 41. When the pressure in the chamber 41 reaches the predetermined opening value for the injector valve 22, an injection occurs through the orifice 23 into the engine cylinder. Injection continues as the plunger 20 moves downwardly under the influence of the pressure in chamber 33 until such time as the port 39 is again uncovered as shown in the drawing. At this point, the fuel pressure in chamber 33 is immediately reduced and the injector valve 22 closes abruptly to terminate injection of the fuel.

It may readily be seen that with the present system the fuel is injected in a precisely controlled manner with a minimum of costly machined parts. The quantity of fuel being injected is accurately metered by the device 3 before it is transmitted to the chamber 41 to cause the displacement of the plunger 20 by a predetermined finite amount. When such amount of fuel enters the chamber 41, movement of the plunger 20 stops and a state of equilibrium exists between the fluids in the chambers 41 and 33.

It should be noted that the floating plunger 20 is displaced in accordance with the amount of fuel metered into chamber 41. This amount is dependent upon engine load and is correlated therewith. Although the volume in the chambers 41 and 33 may vary depending upon the amount of fuel needed by the device 3, the sum total of the two volumes does not change. Thus, the plunger 20 will begin to move downwardly under the influence of the pressure in the chamber 33 in a given timed relationship with the crank shaft of the engine to which the movement of the power piston 25 is directly related.

It will be appreciated that the instant invention provides a relatively simple mechanism which achieves results formerly effectively achieved only by complex, multi-component injector systems. The present invention allows close control of injection rate and duration, elimination of secondary injection, and a system less sensitive to the effects of fuel heating and orifice restriction. Calibration of the device while mounted on the engine is not necessary and racks or other regulating means for fuel amount and timing control generally associated with rotating scroll type plunger systems are rendered unnecessary.

While the invention has been described with particular reference to the preferred embodiment, it should be apparent that variations and modifications are possible within the purview of the inventive concepts. No limitations with respect to these variations and modifications are intended except those implicit in the scope of the appended claims.

Another feature of this injector is the self-compensating or adjusting capability of plunger 20. For example, if all of the fuel in chamber 41 for some reason is not completely discharged, minute surpluses can accumulate between the injection strokes. Such momentary fuel accumulation is readily accommodated by additional upward movement of plunger 20 and matching discharge of fluid from chamber 33 through ports 30. The following injection stroke normally will eliminate any surplus fuel in chamber 41.

We claim:

1. A unit fuel injection system comprising; housing means having first bore means therein, piston means reciprocatingly mounted within said first bore means and biased to a first position, injection means for selectively communicating fuel from said first bore means to a point of fuel utilization, unrestrained free-floating plunger means slidably mounted within said first bore means between said piston means and said injection passage means, first chamber means formed within said first bore means between said floating plunger means and said piston means, first fluid communication means for communicating first fluid from a first source thereof to said first chamber means; second chamber means formed within said housing means between said unrestrained floating plunger means and said injection passage means; second fluid communication means for communicating a second fluid from a second source thereof to said second chamber means with said piston means in a first position;

said piston means including a piston member, biasing means for urging said piston member in a first direction away from said injection passage means to said first position, and cam means operable for periodically urging said piston member in a second direction toward a second position allowing said piston member to block said second communication means immediately upon movement from said first position.

2. The invention of claim 1 wherein said injection passage means include one-way injector valve means for communicating said second fluid from said second chamber means to said point of utilization and for preventing flow from said point to said second chamber means.

3. The invention of claim 2 wherein said second source includes fuel metering means for selectively supplying a given predetermined charge of fuel to said second chamber means.

4. The invention of claim 2 wherein said first fluid communication means includes first and second ports communicating between said first chamber means and said first source, wherein said first and second ports are closed by passage thereover of said piston member and said plunger means respectively, said ports being open for free fluid communication therethrough when said piston member is in the first position and said plunger means is not disposed in fluid blocking position with respect thereto.

5. The invention of claim 4 wherein said piston means include annular groove means about the periphery thereof in fluid communication with said first chamber means for supplying first fluid between said piston means and said first bore means.

* * * * *